United States Patent [19]

Hallam et al.

[11] 4,164,188

[45] Aug. 14, 1979

[54] SELF STEERING RAILWAY CAR

[75] Inventors: Keith J. Hallam, Merrillville, Ind.; Willis H. Knippel, Palos Park, Ill.

[73] Assignee: Pullman Incorporated, Chicago, Ill.

[21] Appl. No.: 800,687

[22] Filed: May 26, 1977

[51] Int. Cl.[2] ..... B61C 3/00; B61F 3/04; B61F 5/22; B61F 5/46

[52] U.S. Cl. ..... 105/166; 105/135; 105/136; 105/168; 105/176; 105/182 R

[58] Field of Search ..... 105/4 R, 109, 118, 133, 105/135, 165, 166, 167, 168, 171, 174, 175 R, 176, 179, 136, 182 R; 180/12; 280/100

[56] References Cited

U.S. PATENT DOCUMENTS

| | | | |
|---|---|---|---|
| 638,665 | 12/1899 | Green | 105/176 |
| 1,256,558 | 2/1918 | Hild | 105/179 X |
| 1,682,517 | 8/1928 | Houston | 105/175 R |
| 1,723,720 | 8/1929 | Buchli | 105/109 |
| 1,728,096 | 9/1929 | Algrain | 105/166 |
| 1,953,401 | 4/1934 | Giger | 105/175 R |
| 1,973,816 | 9/1934 | Kruckenberg et al. | 105/174 X |
| 2,245,333 | 6/1941 | Frei | 105/168 |
| 3,687,085 | 8/1972 | Newman et al. | 105/171 |
| 3,696,757 | 10/1972 | Newman et al. | 105/171 X |

*Primary Examiner*—Francis S. Husar
*Assistant Examiner*—Howard Beltran

[57] ABSTRACT

A railway car includes a chassis supported on two sub-frames which are relatively pivotally movable. The sub-frames support propulsion motors, differentials, and driven flanged wheels. And intermediate steering axle and wheel assembly are transversly movable in response to track curvature and a steering beam extending outwardly from the steering axle pivots the sub-frames for steering movement.

26 Claims, 7 Drawing Figures

SELF STEERING RAILWAY CAR

BACKGROUND OF THE INVENTION

1. Field of the Invention

The field of invention relates to passenger transit vehicles and more specifically to a railway vehicle which includes a center axle steering arrangement.

2. Description of the Prior Art

The prior art is exemplified in the following U.S. Pat. No. 1,682,517 illustrates a multi-trucked vehicle wherein the center truck partially supports the weight of the vehicle. U.S. Pat. No. 1,723,720 illustrates a railway vehicle with a steering arrangement wherein the steering axle is supported by pendulously mounted arms. U.S. Pat. No. 1,728,096 illustrates a steerable railway vehicle whereby orientation of the trucks is accomplished by means of a longitudinally positioned, rotatable shaft. U.S. Pat. No. 1,953,401 shows a manner of affecting the orientation of a railway locomotive's driving axle by interconnecting it with an outer truck. U.S. Pat. No. 1,973,816 shows a railway vehicle suspension. U.S. Pat. No. 3,687,085 shows an improved suspension for a railway vehicle wheelset. U.S. Pat. No. 3,696,757 illustrates a steering beam arrangement suitably connected between adjacent ends of two railway vehicles. The present invention is distinguishable from the prior art as will become apparent from the following specification.

SUMMARY OF THE INVENTION

In the present invention a rail transit car comprises a body supported on a chassis having longitudinally extending frame members, out-board support members and inner transverse support beams. The chassis is supported on two sub-frames which are pivoted to the chassis for rotation about vertical axes. The sub-frames include axle and wheel assemblies which are driven by means of a propulsion motor supported on each of the sub-frames driving through a differential gear housing. The sub-frame also includes air bag suspension and shock absorbing means to provide a comfortable ride.

The sub-frames are steered by means of a central steering axle assembly which is transversely movable in response to track curvature when the vehicle enters a curve. The sub-frames immediately adjacent opposite sides of the intermediate axle are supported by means of roller assemblies on arcuate transversely extending support tracks or members. As the steering axle is moved transversely a steering beam also is moved transversely and remains in substantially parallel relation with respect to the longitudinal beams of the chassis. The steering beam is connected by means of spherical bearing and socket connections to the sub-frames to rotate them so that the wheels are steered as the car goes around a curved track. This of course provides for precise steering and eliminates the problems of track and wheel noise, etc., and discomfort occasioned by non-steering arrangements conventional in the art.

BRIEF DESCRIPTION OF THE DRAWINGS

FIG. 1 discloses a railway passenger car 10 having a conventional car body 11 including windows 12 and suitable sliding doors 13. The passenger car 10 is supported on a longitudinally extending chassis 14 which as best shown in FIGS. 2 and 3 comprises longitudinally extending frame members 15 which include outwardly extending side posts 16 adapted to be connected to the underneath side of the railway passenger car 10 for supporting the same in cushioning arrangement. The car is shown as being positioned on a track 15.

Figure 1:
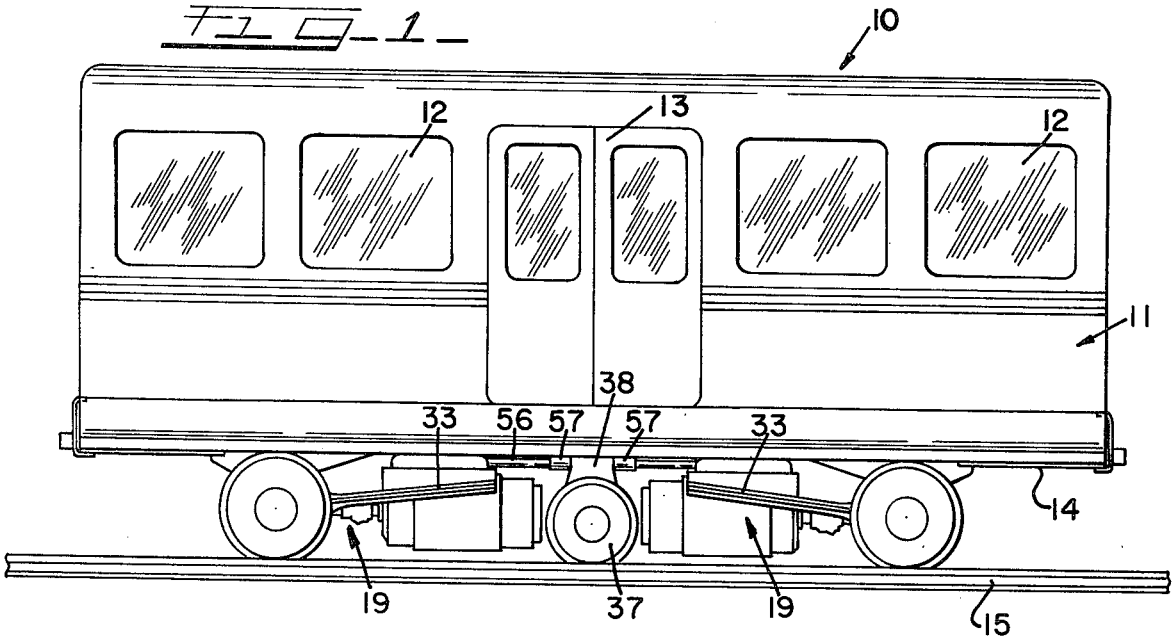
FIG. 1 is a side elevational view of a transit car.
Figure 4:
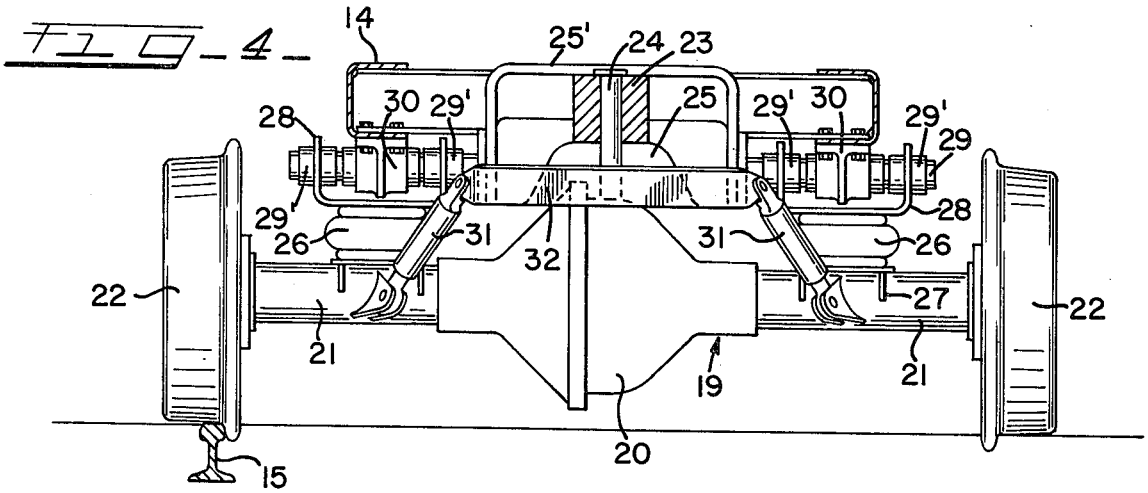
FIG. 4 is a cross-sectional view taken substantially along the line 4—4 of FIG. 2.
Figure 2:
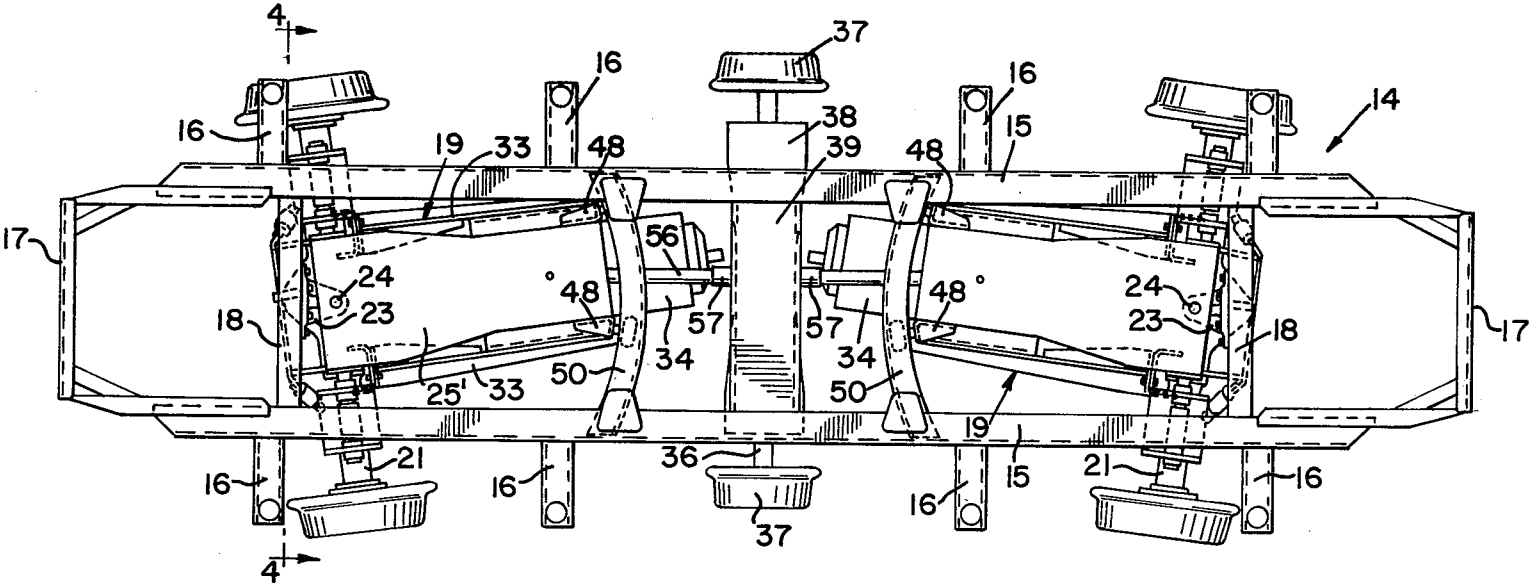
FIG. 2 is a plan view of a chassis of a transit car showing a pair of sub-frame assemblies.

The chassis includes end support members 17 and intermediate transverse support 18. The chassis 14 is supported on a pair of end axle and wheel assemblies or sub-frames 19 each of which includes a differential gear housing 20 and outwardly projecting driven axles 21 which provide power for driving car wheels 22. Each of the sub-frames 19 is connected to the outermost transverse support 18 for pivotal movement about a vertical pivot axes by means of a pivot bracket 23 and vertical pivot pin 24 suitably connected to the sub-frames 19. A cover plate bracket 25' as best shown in FIGS. 2, 3 and 4 is also provided on each of the sub-frames 19.

The sub-frames 19 also include air suspension bags 26 which are supported on the axle 21 by means of brackets 27. The air suspension bags in turn support brackets 28 which are connected to a transversely extending shaft 29 by means of sleeves 29'. Slide brackets 30 also provide supports for the chassis 14. Each of the sub-frames also includes suitable shock absorbers 31 connected to the axles 21 and to the sub-frames 19 by means of transverse brackets 32. Side frames 33 are suitably connected on opposite sides of the sub-frames 19 through the axles 21 and support thereon propulsion motors 34. The propulsions motors generally are electrical and conventional in transit car locomotion.

Figure 6:
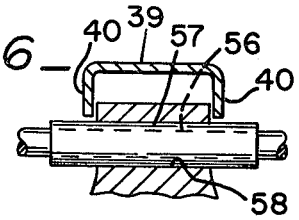
FIG. 6 is a cross-sectional view taken substantially along the line 6—6 of FIG. 5.
Figure 5:
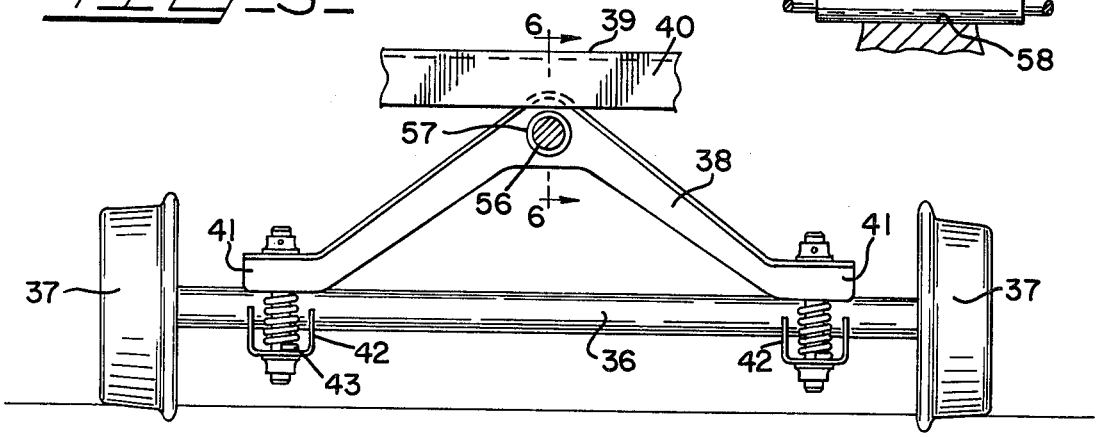
FIG. 5 is a cross-sectional view taken substantially along the line 5—5 of FIG. 3.
Figure 3:
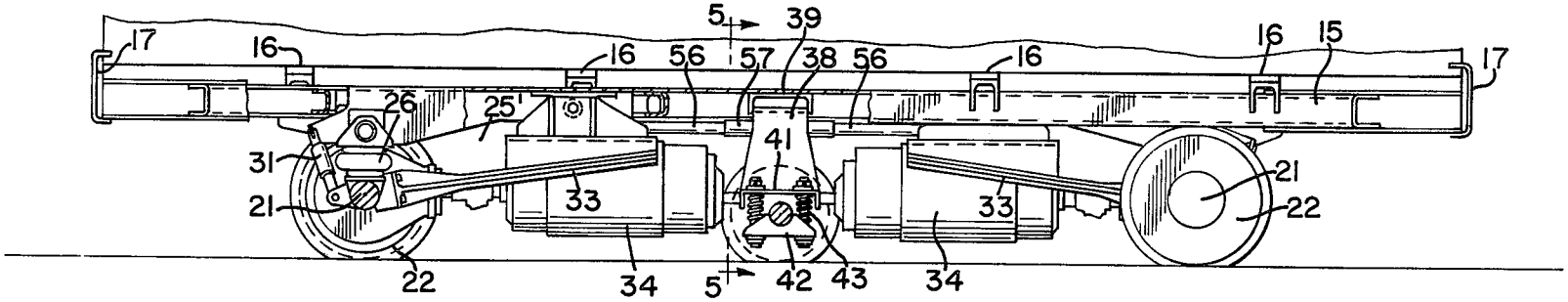
FIG. 3 is a side elevational view of the chassis and sub-frame arrangement shown in FIG. 2.

Referring now particularly to FIGS. 3, 5 and 6 an intermediate steering axle and wheel assembly 36 includes track wheels 37. A yoke or guided bracket member 38 is adapted to be moved transversely and guided by a channel shaped guide member 39 extending tranversely between the longitudinal side frames of the chassis and being connected thereto. The channel shaped guide 39 as best shown in FIG. 6 includes downwardly extending flanges 40 which overlap the upper ends of the yoke 38 and guide the same in its transverse movement. The yoke also includes lower feet 41 which by means of brackets 42 and spring and bolt securing means 43 suitably connect the intermediate axle and wheel assembly 36 to the yoke 38.

Figure 7:
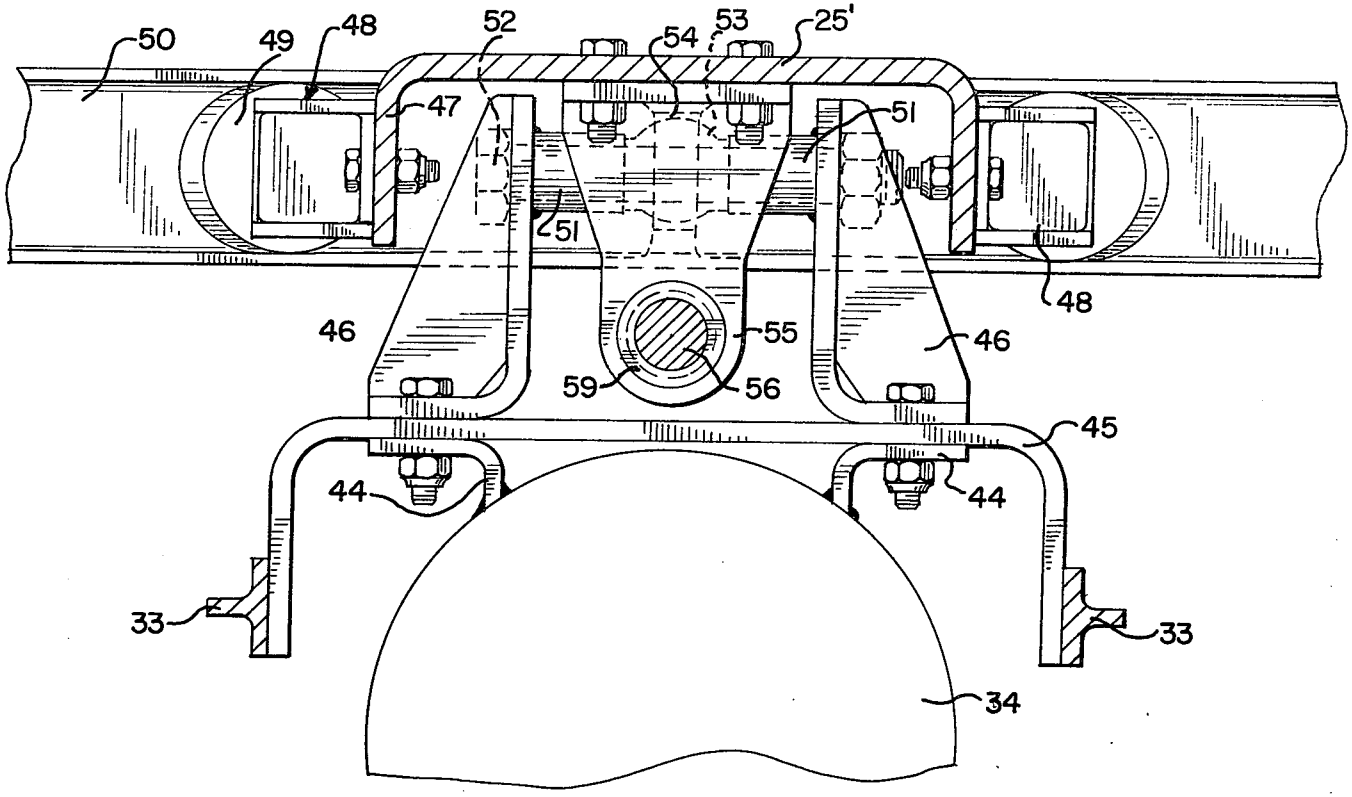
FIG. 7 is a cross-sectional view taken substantially along the line 7—7 of FIG. 3.

As best shown in FIG. 7 the propulsion motors 34 include hanger brackets 44 which in turn are rigidly connected to a U-shaped bracket 45 in turn supported on the side beams 33. The U-shaped hanger bracket 45 is also suspended by means of angle brackets 46 from the cover plate bracket 25'. The cover plate bracket 25' includes downwardly extending flanges 47 to which are connected roller assemblies 48, these in turn being rollingly supported on arcuate channel shaped supports 50 which extend transversely across the chassis as best shown in FIGS. 2 and 3.

The angle brackets 46 are also provided at their upper ends by inwardly projecting sleeves 51 which support a bolt and nut assembly 52. The bolt and nut assembly in turn connects a spherical bearing 53 to a socket bracket 54 which in turn is supported on the cover plate bracket 25' and projects downwardly with respect thereto.

As best shown in FIGS. 2, 3, 5 and 6 a steering beam 56 is supported within a tube 57 in turn supported within a transverse bore 58 in the upper end of the yoke 38. The steering beam extends from the yoke in opposite directions and is connected to the sub-frames in the manner indicated in FIG. 7. In FIG. 7 the steering beam 56 is shown as having at one end thereof a spherical bearing 59 which permits relative pivoting of the sub-frames while the steering beam maintains a substantially parallel position relative to the side longitudinal beams of the chassis as the intermediate steering axle is moved transversely or laterally with respect to said chassis. Also the spherical bearing construction 53 permits relative pivoting movement of the bracket 45 relative to the bracket 25'.

THE OPERATION

During the operation of the transit car as it enters a curve, the intermediate axle and wheel assembly 36 and wheel 37 are moved to the position indicated in FIG. 2. The steering beam 56 is of course also moved outwardly to one side of the chassis and in so doing by virtue of its connection to its sub-assemblies as indicated in FIG. 7 the sub-assemblies are moved to the position shown in FIG. 2 wherein the axle 21 and wheels 22 are positioned to be steered in the direction of the curved track. The arcuate track and roller assemblies provide for positive support and effectuate precise steering in response to the movement of the steering beam 56.

The present vehicle arrangements achieves precise steering, simple design with a minimum of parts usage and a minimum of unsprung weight. Further, it eliminates all of the many curving problems of vehicles which do not have the intermediate axle steering arrangements. The sub-frames are particularly advantageous in that they rotate around a fix pivot pin on the chassis. Thus the sub-frames not only act as an important link for the steering arrangement but also as a support for the electric motor and other equipment to propel the vehicle. As indicated in FIG. 7, the sub-frames include the arrangement where two spherical bearings are connected to the motor mount and the roller assembly which permits the axle to rotate in two directions. Further the lower spherical bearing allows the center steering beam shaft to change angle with the sub-frame when the vehicle is negotiating a curve section of track. A further advantage disclosed is the center steering axle assembly which is restrained by the guide and allows the assembly to always remain normal to the longitudinal center line of the vehicle. Thus as the axle moves laterally across the longitudinal vehicle the steering beam also moves in said direction thereby moving and rotating the sub-frames during its process. The advantages of the assembly are reduced wheel noise and wear, an improved wheel traction, and reduced vibration which thereby reduces fatigue of the vehicle structure and improves braking of the vehicle.

What is claimed is:

1. A railway car having a body, an under frame for supporting said body including a chassis, a sub-frame assembly at each end of the chassis, each sub-frame including a first axle and drive wheels supporting the chassis, means connecting each sub-frame assembly for turning movement relative to said chassis for guided engagement with associated tracks, a second axle and wheel assembly positioned between said sub-frames, guide means slidingly guiding said second axle and wheel assembly for transverse movement relative to said chassis, said guide means including a guide element extending transversely of said chassis, and said second axle and wheel assembly including a guided yoke member supported by said second axle with means on said guided yoke member engaging said guide member in slidingly guided relation during relative transverse movement whereby positive engagement of said second axle and wheel assembly with associated tracks is assured, and a steering beam assembly directly connected to said second axle and wheel assembly and longitudinally projecting therefrom toward respective sub-frame assemblies and directly operatively connected to each of said sub-frames and movable in a substantially constant horizontal plane with said second axle and wheel assembly transversely relative of the car in response to track curvature and turning said sub-frames for steering said drive wheels.

2. The invention in accordance with claim 1, said guide element including a channel shaped member.

3. The invention in accordance with claim 1, including means pivotally connecting said steering beam to said sub-frames for pivotal movement.

4. The invention in accordance with claim 3, said pivotal means connecting said steering beam including a bearing and socket connection.

5. The invention in accordance with claim 1, said chassis having a pair of laterally spaced longitudinally extending frame members connected by a plurality of transversely extending members.

6. The invention in accordance with claim 5, wherein the means connecting each sub-frame assembly to said chassis comprise pivotal connections for pivotal movement of said sub-frames about vertical axes.

7. The invention in accordance with claim 6, and each said sub-frame assembly including a motor support structure extending toward said second axle and wheel assembly.

8. The invention in accordance with claim 7, including transversely extending support brackets positioned on opposite sides of said second axle.

9. The invention in accordance with claim 8, including means on said motor support structure movably supported on said support brackets.

10. The invention in accordance with claim 9, said support brackets having an arcuate configuration, and said movable means on said motor support structure comprising rollers.

11. The invention in accordance with claim 10, said movable means on said motor supports comprising roller carriage carried by said arcuate brackets, and said steering beams including means pivotally connecting the same to said roller carriage.

12. The invention in accordance with claim 10, said steering beam during transverse movement remaining substantially parallel to said longitudinal chassis members.

13. The invention in accordance with claim 12, including propulsion motors carried on said motor support structure for driving said driven wheels.

14. The invention in accordance with claim 13, said first axle including differential drive means connected to said propulsion motors.

15. In a railway car support structure, a longitudinally extending chassis having a pair of end axle and wheel assemblies supporting said chassis and an intermediate axle and wheel assembly, means connecting each end axle and wheel assembly for turning movement relative to said chassis for guided engagement with associated tracks, means between said chassis and said intermediate axle and wheel assembly providing slidingly guided transverse movement of said intermediate assembly relative to said chassis, whereby positive engagement of said intermediate axle and wheel assembly with associated tracks is assured, and steering beam means directly connected to said intermediate axle and wheel assembly and extending to and directly articulatingly connected with respective end axle and wheel assemblies, said steering beam means being operative in a substantially constant horizontal plane attendant to lateral movement of said intermediate axle and wheel assembly to effect pivoting of said end axle and wheel assemblies for steering.

16. The invention in accordance with claim 15 said steering means remaining substantially longitudinally parallel to said longitudinally extending chassis during transverse movement of said steering means.

17. The invention in accordance with claim 16, including means articulatingly connecting said steering means to said end axle and wheel assemblies comprising a ball and socket connection.

18. The invention in accordance with claim 15, said means for restricting movement of said intermediate axle and wheel assembly including a transversely extending guide element, said intermediate axle and wheel assembly including a guide yoke member supported by the second axle, and means on said guided yoke member engaging said guide element in guided relation during transverse movement.

19. The invention in accordance with claim 18, said guide element including a channel-shaped member.

20. The invention in accordance with claim 15, wherein said means connecting each end axle and wheel assembly for turning movement relative to said chassis comprise pivotal connections for pivotal movement of said end axle and wheel assembly about vertical axes.

21. The invention in accordance with claim 15, wherein each of said end axle and wheel assemblies includes a motor support structure extending toward said intermediate axle and wheel assembly.

22. The invention in accordance with claim 21, including transversely extending support means positioned on opposite sides of said intermediate axle and wheel assembly.

23. The invention in accordance with claim 22, including means on said motor support structures movably supported on said support means.

24. The invention in accordance with claim 23, said support means having an arcuate configuration, and said movable means on said motor support structure comprising rollers.

25. The invention in accordance with claim 24, including propulsion motors carried on said motor support structure for driving said driven wheels.

26. The invention in accordance with claim 25, said end axle including differential drive means connected to said propulsion motors.

* * * * *